US005110039A

United States Patent [19]

Philips

[11] Patent Number: 5,110,039

[45] Date of Patent: May 5, 1992

[54] SINGLE PIECE FOOD PACKAGE

[75] Inventor: Nicholas A. Philips, West Chicago, Ill.

[73] Assignee: Weyerhaeuser Company, Tacoma, Wash.

[21] Appl. No.: 613,173

[22] Filed: Nov. 14, 1990

[51] Int. Cl.[5] ..... B65D 5/24

[52] U.S. Cl. ..... 229/110; 229/146; 229/906

[58] Field of Search ..... 229/110, 146, 906, 146, 229/145, 154

[56] References Cited

U.S. PATENT DOCUMENTS

| | | | |
|---|---|---|---|
| 2,265,326 | 12/1941 | Stopper | 229/146 |
| 3,261,533 | 7/1966 | Repking | 229/109 |
| 3,459,359 | 8/1969 | Heffernan | 229/146 |
| 3,652,086 | 3/1972 | Stecker | 229/146 |
| 4,215,810 | 8/1980 | Zicko | 229/146 |
| 4,304,329 | 12/1981 | Graser | 229/109 |
| 4,427,147 | 1/1984 | Wischusen | 229/146 |
| 4,718,596 | 1/1988 | Müller et al. | 229/109 |
| 4,765,534 | 8/1988 | Zion et al. | 229/906 |
| 4,979,667 | 12/1990 | Seaman | 229/109 |

*Primary Examiner*—Stephen Marcus
*Assistant Examiner*—Christopher McDonald

[57] ABSTRACT

A paperboard container is formed from a single piece with appropriate cuts, score lines and slots to become, when in the erected condition, a food container for holding hot food such as pizzas. Top and bottom panels are provided as are appropriate side panels. At the back side panel on each side thereof panels are provided whereby two opposed triangular flaps are folded back over an angle of 180° to form a multi-layer construction to add to the strength. In another embodiment, front angled corners are constructed where triangular panels are created as is a generally rectangular antislide panel which, when the bottom receptacle portion is formed will be inclined inwardly within the interior of the container to form an antislide barrier.

2 Claims, 2 Drawing Sheets

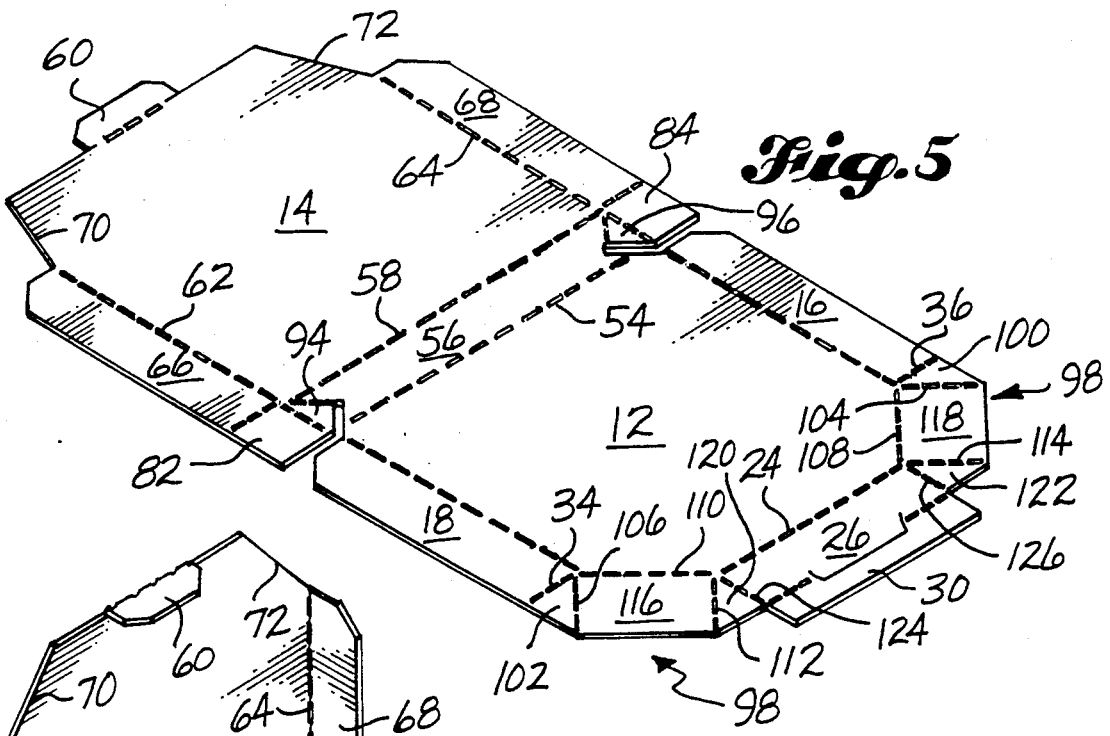
Fig. 5
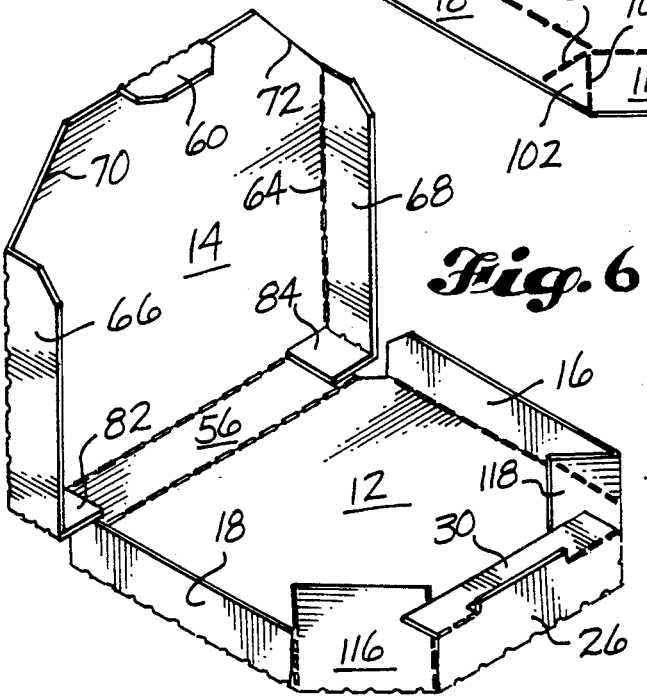
Fig. 6
Fig. 8
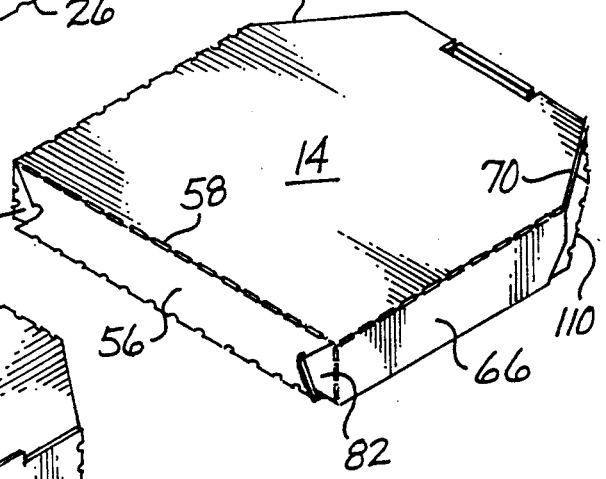
Fig. 7
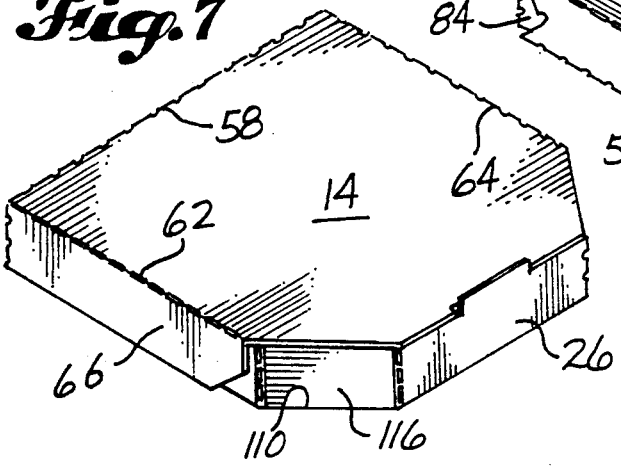

SINGLE PIECE FOOD PACKAGE

BACKGROUND OF THE INVENTION

In the field of food packaging, various food products are packaged for distribution in many different ways. Typically the packaging should be a relatively small portion of the overall price of the packaged food item while still providing safe and effective packaging and reasonably attractive shapes and graphics.

Over the years various paperboard products have been adapted for use as food packages. Single piece foldable paper blanks are often used to package all different kinds of food items. Well recognized will be, for example, paper ice cream cartons, paper milk cartons, corrugated shipping containers for holding produce, cans and the like, and others. Ordinary consumers will recognize that, for example, paper ice cream cartons are constructed from a single layer of paper material usually laminated with an appropriate plastic, likewise with paper milk cartons. For heavier duty packages a multilayer corrugated containerboard is utilized.

The containers made from paper materials have certain characteristics in common, among them being their relatively low cost, their ease of cutting, scoring and slitting capabilities, their relatively light weight, and of more importance recently, their recyclability.

In the packaging of food items that are substantially round in nature, such as flat pizzas for carry out, it has become well accepted that corrugated multi-layer paper materials can be utilized to form the package. Various structures have been proposed using corrugated shipping container material where they are cut, scored and slotted in order to then be folded into a relatively flat, generally rectangular box for containing one or more pizzas. A typical example of such a container is illustrated in U.S. Pat. No. 4,765,534 issued Aug. 23, 1988 and assigned to Stone Container Corporation.

In addition to low cost, ease of formation, recyclability, and overall attractiveness, a container for containing carry out pizza must also have good insulating properties, be extremely easy to fold from a flat condition into a folded up container. Another desired feature within a pizza container is suitable means for preventing sliding once the pizza is packaged. A reasonably tight fit is desirable to hold the pizza in place while it is being transported to the location for ultimate consumption.

Yet another desirable feature which relates directly to the overall cost of the package is to provide a container design that utilizes the least amount of paper material while providing the necessary functionality.

According, from the foregoing, one object of the present invention is the provision of a relatively low cost single piece food package.

Another object is to provide a single piece, easily erectable and recyclable paper food package.

Still a further object is to provide a single piece, relatively flat generally rectangular food container suitable for holding and retaining the heat for substantially round pizzas.

Still a further object is to provide means in the container for preventing sliding of the pizza once it is packaged within the container.

These and other objects of the present invention will be well understood upon reading the specification to follow in conjunction with the attached drawings.

SUMMARY OF THE INVENTION

The present invention is practiced in one form by a single piece container made from paperboard which has a generally rectangular planer shape and is relatively short in the height dimension for containing food products such as relatively round, carry out pizza. The container has relatively rectangular top and bottom walls and four side walls. The front side wall is hinged to the bottom wall as is the back side wall. Two side walls are likewise hinged to opposed edges on the bottom wall. The top wall which forms the closure panel is hinged along the top edge of the back side wall. At each end of the back side wall a special feature is provided which includes an angled, elongated slot extending upwardly and inwardly from the apex at the juxtaposed corner of the bottom wall to a location at approximately one-half the height dimension of the back side wall. Score lines angle back from the end of the elongated slot at an angle of approximately 90° toward the adjacent corner within the top wall. Extending outwardly from the two opposed side edges on the top wall are side flaps to which a hinged corner flap is attached. A relatively small triangular flap is created which is formed by the elongated slot, the angled score line and a score line extending in line with the score line between the top wall and each side flap. On the front side panel there is a foldable tab with a slot therein to cooperate with the top wall or closure panel for holding the top wall in place after a pizza is inserted. Additional means are provided at the ends of each side wall for forming an angled structure extending between the side walls and the front wall.

BRIEF DESCRIPTION OF THE DRAWINGS

FIG. 5 is a view similar to FIG. 1 showing a single piece paper blank with an alternate embodiment for the construction of the front angled corners.

FIG. 6 is a view similar to FIG. 2 showing the alternate front angled corners.

FIG. 7 is a view similar to FIG. 3.

FIG. 8 is a view similar to FIG. 4.

DETAILED DESCRIPTION OF THE PREFERRED EMBODIMENTS

Figure 1:
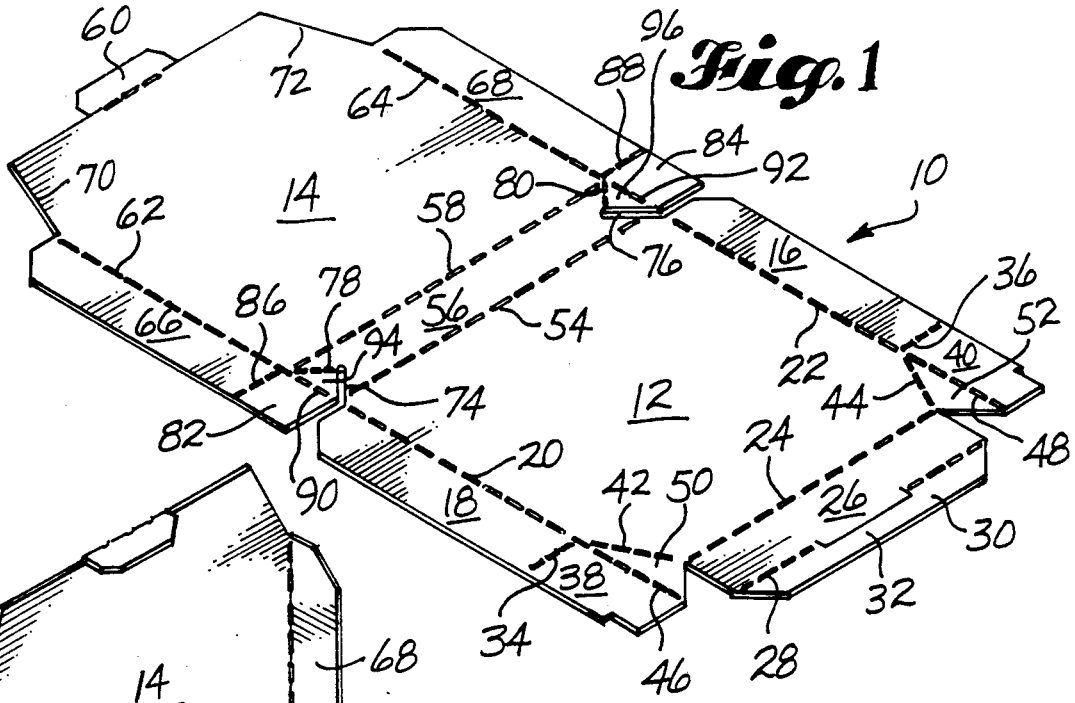
FIG. 1 is an isometric view illustrating a single piece flat blank, cut, scored and slotted according to the present invention.

Referring first to FIG. 1, the single piece cut, scored, slit and slotted paperboard blank is indicated generally at 10. The blank 10 has a generally rectangular bottom wall or panel 12 and a corresponding top or closure wall or panel 14. Extending outwardly and hinged thereto from the opposed side edges of bottom panel 12 are side walls 16, 18 along score lines 20, 22. Extending outwardly from score line 24 is a rectangular front wall or panel 26. Extending further outwardly from score line 28 along the top edge of front panel 26 is a relatively short folding tab 30. Located along score line 28 is a slit 32 forming part of the closure means. Hinged to each end of side panel 16, 18 along respective score lines 34, 36 are angled front corner walls or panels 38, 40. A pair of hinge lines 42, 44 angle from one corner of the corner walls 38, 40 over toward the respective end points of score line 24. This is allowed by making the length of front panel 26 less than the overall width of bottom panel 12. Score lines 46, 48 are also created along a line extending linearly with score lines 20, 22 thereby forming a pair of opposed triangular shaped flaps 50, 52. This particular structure, i.e., the formation of corner flaps 50, 52 is known and illustrated in the U.S. Patent to Stone Container-U.S. Pat. No. 4,765,534. As is evident in the Stone patent, when the food package is folded, the side walls 16, 18 and corner panels 38, 40, along with the triangular shaped panels 50, 52 will be oriented in the configuration illustrated in FIG. 2.

Extending outwardly from hinge line 54 from the back edge of bottom panel 12 is the rear side or wall panel 56. Extending further outwardly from the top edge of panel 56 along hinge line 58 is the top, generally rectangular closure panel 14. The overall width of top panel 14 will be substantially equal to that of bottom panel 12 and the orthogonal dimension will be approximately equal to that same dimension of bottom panel 12. Extending outwardly from the edge of top panel 14 opposite hinge line 58 is a closure tab 60 which will be insertable into slit 32 upon closure. As shown, there are laterally opposed hinge lines 62, 64 on either side of top panel 14 and depending therefrom are side flaps 66, 68. Opposed edges 70, 72 are angled inwardly and terminate at points which will establish a dimension substantially equal to the length of front side panel 26.

One unique feature of the present invention includes a pair of opposed angled, elongated slots 74, 76 which extend in the back panel 56 from each corner of bottom panel 12 inwardly to a location approximately one-half of the height dimension of rear panel 56. The angle should be at 45° with score line 54. Opposed score lines 78, 80 angle back toward the opposed corners on top panel 14 from the ends of slots 74, 76. A generally rectangular panel is created at the ends of side flaps 66, 68, indicated at 82, 84 respectively through hinge lines 86, 88, and 90, 92. Opposed triangular shaped support panels 94, 96 are thusly created and if desired, a suitable adhesive may be applied to the inside surface of each triangular flap 94, 96. The adhesive will be functional to hold the angular corner configuration in place when the container is fully erected, as particularly depicted in FIG. 2.

Figure 2:
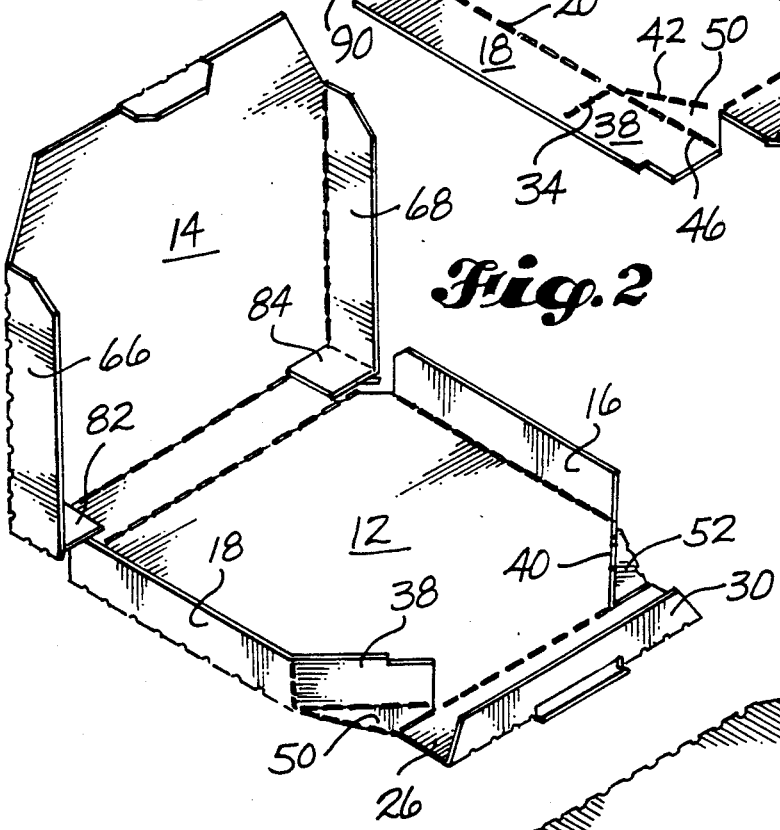
FIG. 2 is also an isometric view showing the single piece blank partially erected.
Figure 4:
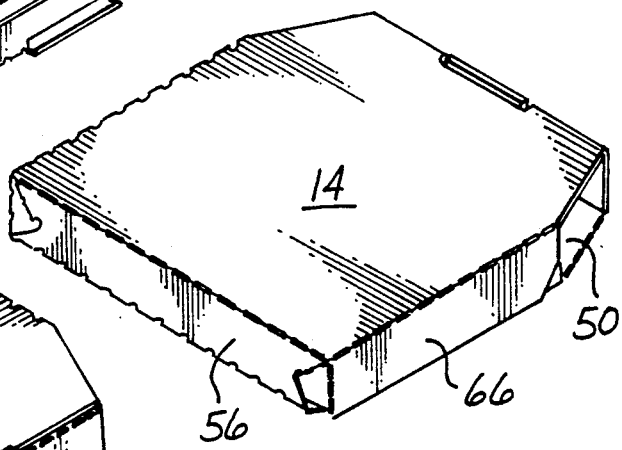
FIG. 4 is also an isometric view showing the top wall being closed and illustrating the configuration of the back wall.
Figure 3:
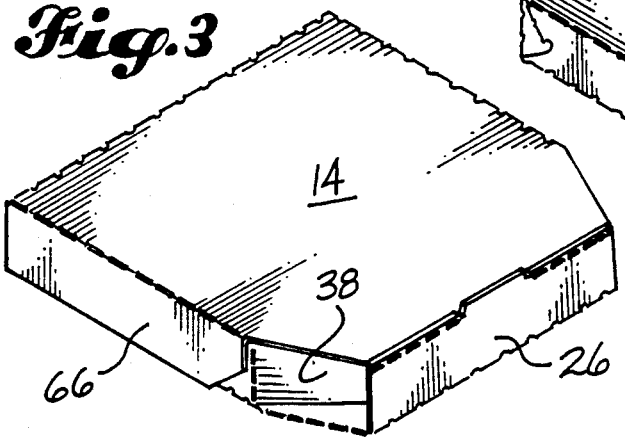
FIG. 3 is similarly an isometric view illustrating the front angled corner construction.

Turning now to FIGS. 2–4, the folding sequence will be described. First, the angular front corner panels can be folded and moved into position. Just as adhesive can be used on panels 94, 96, adhesive may be used on panels 50, 52. As shown in FIG. 2, side panels 16, 18 are folded upwardly to make a 90° angle with bottom panel 12 and at the same time panels 38, 40 are folded upwardly and inwardly bringing triangular panels 50, 52 up and over rotating through a 180° angle. If adhesive is used, the triangular panels 50, 52 will then adhere to the juxtaposed portions of bottom panel 12. As previously described, the side flaps 66, 68 are moved into position and the triangular flaps 94, 96 are folded 180° to overlie the abutting portions of back side panel 56. In doing so, panels 82, 84 will rotate into the position as depicted in FIG. 2 and become perpendicular to both the adjoining side flap and top panel 14. Thereafter, the food product may be placed atop the bottom panel 12 and front side wall 26 folded upwardly while the top panel and side flaps 66, 68 are brought downwardly and the flap 60 tucked into slit 32. The container in the closed configuration is depicted in FIGS. 3 and 4.

Turning now to FIGS. 5–8, an alternate embodiment will be described. Like reference numbers will be used in FIGS. 5–8 to designate the same elements within the container. In this particular embodiment, the additional novel feature is related to the front angled corner structures, each depicted generally at 98. This novel feature to be described may be used separately or in combination with the use of the folding triangular panels 94, 96 at the rear of the container. This modified angled corner construction 98 serves to likewise provide a hexagonally shaped container and one that has interior structure to limit the sliding of a pizza contained within the formed and closed container. Extending outwardly from the respective side panels 16, 18 are triangular panels 100, 102 which are hinged to score lines 34, 36. Forming the front leg of each triangular flap 100, 102 is a score line 104, 106 which is at an angle of 45° from score lines 34, 36 respectively. Additional score lines 108, 110 extend over to the ends of score line 24. Extending outwardly from the ends of score lines 108, 110 are additional score lines 112, 114 extending outwardly back to the edge of the container blank. Score lines 106, 110, 112 will form antislide flap 116 while score lines 104, 108, 114 will form antislide panel 118. Two additional triangular shaped flaps 120, 122 are formed between score lines 112, 114 and additional score lines 124, 126 extending outwardly at 90° angles from score line 24.

When erecting the container with the angled front corner structure as depicted in FIGS. 5–8, essentially the same procedure will be followed but for forming the bottom receptacle portion of the container. The side walls 16, 18 will be folded upwardly 90° and then the antislide panels 116, 118 will be folded inwardly through an angle of approximately 135° while at the same time the respective triangular flaps 102, 120 and 100, 122 will move upwardly through an angle to ultimately lie in a substantially vertical plane at an angle 45° from side wall 16, 18 as particularly depicted in FIG. 6. Thereafter, the pizza may be inserted into the thusly formed receptacle and it will slide underneath the inclined antislide panels 116, 118 and effectively be held in place. Thereafter, the top panel may be folded over, the back side wall 56 brought into place and tab 60 inserted into slit 32. The tab 30 will be folded over 90° to overlie a portion of the inclined panels 116, 118. The completely closed container is depicted in FIGS. 7 and 8.

Both embodiments of the present invention will be utilized to primarily contain take out pizza where the hot pizza will be retained within the closed container for transport while at the same time retaining as much heat as possible to keep the pizza hot.

While a detailed description has been provided of the present invention, modifications may occur to those skilled in the art. All such modifications are intended to be included within the scope of the appended claims.

I claim:

1. A single piece paperboard container for holding relatively flat circular food products has top and bottom panels with at least four side panels connected to respective edges of the top and bottom panels through hinge lines, having the improvement comprising:

a pair of slots positioned within a back one of said side panels originating at a position adjacent a respective corner of the bottom panel and extending inwardly along an angle of approximately 45° and terminating at a point approximately one-half the height dimension of the back side panel, a pair of triangular support panels extending outwardly from score lines which extend between ends of the slots and adjacent corners of the top panel, and a pair of generally rectangular panels extending outwardly from a pair of hinge lines which form third legs of the triangular supports panels.

2. A single piece paperboard container for holding relatively flat circular food products has top and bottom panels with at least four side panels connected to respective edges of the top and bottom panels through hinge lines, having the improvement comprising:

a pair of angled corner structures on each corner of a front one of said side panels, each angled corner structure comprising:

a generally rectangular antislide panel connected to a bottom panel along a hinge line angled from a bottom corner of an adjacent one of said side panels to a bottom corner of the front side panel, a triangular panel extending outwardly from each end of the antislide panels and interconnected with two of said side panels and the front side panel, whereby the antislide panels are inclined outwardly within the interior of the container and the triangular panels extend in a substantially vertical plane and at an angle of approximately 45° with the two side panels.

* * * * *